US006990307B2

(12) United States Patent
Dera

(10) Patent No.: US 6,990,307 B2
(45) Date of Patent: Jan. 24, 2006

(54) DEVICE FOR TRANSPORTING PARTICLES

(75) Inventor: Thomas Dera, Geislingen (DE)

(73) Assignee: Eastman Kodak Company, Rochester, NY (US)

( * ) Notice: Subject to any disclaimer, the term of this patent is extended or adjusted under 35 U.S.C. 154(b) by 184 days.

(21) Appl. No.: 10/457,959

(22) Filed: Jun. 10, 2003

(65) Prior Publication Data

US 2004/0047658 A1 Mar. 11, 2004

(30) Foreign Application Priority Data

Jul. 2, 2002 (DE) ..... 102 29 569

(51) Int. Cl.
*G03G 15/09* (2006.01)

(52) U.S. Cl. ..... 399/267; 399/276; 399/277

(58) Field of Classification Search ..... 399/265, 399/267, 269, 276, 277, 280, 229
See application file for complete search history.

(56) References Cited

U.S. PATENT DOCUMENTS

| | | | |
|---|---|---|---|
| 3,631,838 | A | 1/1972 | Kushima |
| 5,227,848 | A | 7/1993 | Robinson et al. |
| 5,926,676 | A | 7/1999 | Snelling et al. |

FOREIGN PATENT DOCUMENTS

| | | |
|---|---|---|
| JP | 58055941 | 4/1983 |
| JP | 61281269 | 12/1986 |

*Primary Examiner*—Arthur T Grimley
*Assistant Examiner*—Ryan Gleitz
(74) *Attorney, Agent, or Firm*—Lawrence P. Kessler

(57) ABSTRACT

A device (100) for the transport of particles (30), in particular development particles (30) with a first magnetic roller (11) and a second magnetic roller (22) , in which the first magnetic roller (11) and the second magnetic roller (22) form a gap, and with a photographic element (1) for the particles (30), which moves through the gap, while the magnetic rollers (11, 22) turn in the same direction.

9 Claims, 1 Drawing Sheet

DEVICE FOR TRANSPORTING PARTICLES

FIELD OF THE INVENTION

The invention relates in general to an electrographic, electrostatographic or an electrophotographic printer or copier and specifically a device for the transport of particles, in particular marking particles, in a photographic element in such printer or copier.

BACKGROUND OF THE INVENTION

Typically, marking particle transport devices are used to transport developers from a storage area to a photographic element. The photographic element is usually an image carrier, which is stretched over one or several rollers, for example an endless band, which already has a latent image thereon. The developer is a mixture, composed of at least magnetic carrier particles and non-magnetic marking particles, in which the marking particles attach to the magnetic carrier particles through triboelectric charging. As soon as the non-magnetic marking particles attach to the latent image on the photographic element, the magnetic carrier particles are removed again. Finally, the image composed on the marking particles is transferred to a paper-like or endless print substrate, and the non-magnetic marking particles are fixed to such substrate in a fixing station through pressure and heat.

To transfer such a developer mixture to the substrate, typically a so-called magnetic brush is used, which is known in the state of the art. For example, in U.S. Pat. No. 4,357,103, such a magnetic brush developer device is described. The magnetic brush developer device shown there displays a non-magnetic cartridge, which situated near the photographic element and slowly rotates. The developer is transported to this cartridge. The developer attaches to the cartridge because there is a multi-polar magnetic roller inside the cartridge, which attracts the magnetic carrier particles and presses on the surface of the cartridge. In this specification, a further magnet is located opposite the photographic element, which reduces the magnetic field of the multi-polar magnet roller in the contact area of the developer and the photographic element and thereby eases the transfer of the developer.

In the European disclosure specification EP 929 006 A2, a cartridge containing a multi-polar magnet roller is shown, in which the cartridge and the multi-polar magnet roller rotate at the same time. In addition, there has also been added an electromagnet on the opposite side of the photographic element, which is controlled in such a way that the desired magnetic field is formed in the contact area between cartridge and photographic element. A comparable device can also be seen in the Japanese specification JP 57118269 A2.

In the Japanese specification JP 57078575 A2, two multi-polar magnet rolls are used, which are situated on both sides of a photographic element, in order to bring the magnetic developer on to the photographic developer. In this case, the multi-polar magnet rolls turn in an opposite direction to each other.

In order to gain more influence on the spatial distribution of the magnetic forces in a typical developer station or other device for the controlled transport of magnetic particles or mixtures of magnetic and non-magnetic particles, in order to stem or compress the developer for example or to remove it from a surface, it would be advantageous to have a stationary, i.e., constant in its strength, magnetic field.

If a force from the magnet roller is not wanted locally, then an additional magnet must be added. The field is then calculated from the absolute value of the vector totals of the magnetic inductions. This overlapping of a stationary magnetic field with a rotating multi-polar field is alternately constructive and destructive and therefore, the absolute value is not constant. It behaves in a similar way if the second magnet is a roller, which turns in an opposite direction. In this instance, it is not possible to create a stationary magnetic field.

SUMMARY OF THE INVENTION

In view of the above, it is clear that there is a need for devices for the transport of particles in a developer station of a digital printer or copier. Therefore, the invention provides an improved device for the transport of particles, in particular, for the transportation of magnetic developers in a developer station of an electrographic, electrostatographic or electrophotographic printer or copier.

The rotation of the multi-polar magnetic rollers in the same direction has the following physical reasons. The potential energy E of a magnetic dipole, which is already directed toward the external field direction, is equal to the negative product of the absolute value of its dipole momentum m and the absolute value of the magnetic induction B. $E=-|m||B|$. The translative force $F=-\text{degree } E=|m| \text{ degree } |B|$ is determined with the gradients of the absolute value of the magnetic induction. If the absolute value $|B|$ is constant at any given location (i.e. although the field vectors can still turn, they cannot alter their length), then a temporal constant magnetic field for aligned magnetic dipoles results. Permanent magnetized or magnetizable particles, as are found for example in the 2-component developer or magnetic marking particles such as toner, of an electrographic or electrophotographic copier or printer, are produced by such magnetic dipoles. Below, such powders that contain magnetic dipoles will be termed as developers. In the magnetic field, the magnetic particles are aligned in the direction of the magnetic field and are ordered in chain-like structures along the field lines.

Therefore, in a suitable configuration of the device, the magnet rollers are multi-polar magnet rollers with a sine magnetic profile. A rapidly rotating magnet roller is especially used with the SPD (small particle dry) development process of Eastman Kodak Company. This is a two-dimensional multi-pole including several transversal magnetized magnets, which are attached to the surface of a cylinder in such a way that the radial magnetization alternates harmonically around the circumference of the cylinder. That means that if the roller rotates, a stationary hall probe, which measures the radial or tangential component of the magnetic induction, shows a sine or cosine course. In this case, the absolute value of the magnetic field is independent of the turning angle (because of $\sin(\Phi)^2+\cos(\Phi)^2=1$), but decreases sharply with the distance from the axis. The force on an aligned magnetic dipole is always radial in the direction of the axis.

In an especially suitable configuration of the device, the rotation of the magnetic rollers is synchronized as the magnetic rollers each rotate around their axes that both have the same pole changing frequency, so that the absolute value of the total magnetic field of the two magnetic rollers is temporally constant. With only one magnetic roller, the force which an aligned magnetic particle experiences is only dependent on one single coordinate, namely on the distance from the axis. This force is always directed toward the axis of the magnetic roller. If the magnetic field of a rotating magnetic roller overlaps the fields of other magnets that are not synchronized, then the absolute value of the total magnetic induction is no longer constant at a given location. This means that the chain-like patterns along which the magnetic particles are arranged are no longer stable.

In contrast, by synchronizing the magnetic rollers, there is the possibility of creating a stationary magnetic field by overlapping the magnetic fields of several magnetic rollers. This field can have a considerably more complex spatial distribution than is possible with only one magnetic roller.

The dynamics of the developer can be controlled in an advantageous manner with such a stationary magnetic field. The spatial distribution of the field can be influenced by the end arrangement of the magnetic rollers, namely by the number of poles of the magnetic rollers used, the radius of the magnetic rollers, the maximum field strength of each magnetic roller and their relatives distances and turning angles to each other. Thus, even with two magnetic rollers, an attracting and a repelling region in the space between the rollers can be created. The configuration possibilities of the field, which controls the dynamics of the magnetized particles, can be expanded even further by adding further synchronized magnetic rollers. Therefore, in the scope of the invention, it is possible to synchronize a greater number than two magnetic rollers with each other.

Magnetic fields that overlap increase vectorially. The magnetic field is strengthened with equally aligned field vectors and weakened—or in extreme cases eradicated—with oppositely aligned field vectors. So that the absolute value of the vector totals is temporally constant, the vectors of the individual magnetic fields must have a fixed angle correlation. This can only be achieved if the magnetic rollers are synchronized, i.e. rotating in the same direction and with the same pole alternation frequency. For example, two magnetic rollers, A and B should be synchronized with each other, where magnetic roller A has 10 poles (alternating between 5 north and 5 south poles) and magnetic pole B has 4 poles. If both magnetic rollers rotate clockwise and magnetic roller A rotates at 1000 rotations per minute, a frequency of 10,000 pole alternations per minute follows for magnetic roller A. This means that magnetic roller B must turn at 2,500 rotations per minute in a clockwise direction.

In a further suitable configuration of the device, the second magnetic roller is set up as dual polar. Only configuring one of the magnetic rollers with two poles is done in order to get as near as possible to the developing zone with the limited range. How quickly the magnetic field decreases with the distance depends on the number of poles. The more poles that are arranged on one magnetic roller, the lower the range of the resulting magnetic field. The largest range of the combined magnetic field from the first and second magnetic field can be attained if one of the magnetic rollers is only set up with two poles.

In a further suitable configuration of the device, the first magnetic roller is eccentrically arranged inside a transport cylinder made of non-magnetic metal. By doing this, the developer can be run through areas of high and low magnetic force with only one magnetic roller, because the distance from the axis of the magnetic roller decreases the attractive power.

In a further suitable configuration of the device, the transport cylinder arranged around the first magnetic roller rotates with lower speed than the first magnetic roller. The higher rotation speed of the magnetic roller essentially contributes toward an improvement in the mixture of the developer, while the rotation speed of the transport cylinder is in contrast essentially responsible for adapting the transport speed of the developer in the direction of the photographic element. The developer has a speed relative to the transport cylinder, whereby the rotating magnetic field vectors force the magnetic particles or groups of magnetic particles to rotate around them. The pole changing frequency is selected so that in time, while the developer moves through the contact area with the photographic element, several pole changes occur.

In a further suitable configuration of the device, the temporally constant field of the amount of the whole magnetic induction of the two magnetic rollers shows a region, which acts repellently on the aligned magnetic dipoles, inside the transport cylinder arranged around the first magnetic roller tight under its casing surface. In this case, the developer experiences a force, which lifts it off the transport cylinder surface. This can be used to bring the developer in contact with the photographic element earlier on the one hand and therefore increase the size of the contact surface and on the other hand, to remove the developer from the transport cylinder after passing through the development zone through repulsion without mechanical contact.

In a further suitable configuration of the device, the temporally constant field of the amount of the whole magnetic induction of the two magnetic rollers shows a region, which acts repellently on the aligned magnetic dipoles, on the other side of the photographic element. In this case, there is an additional force, which repels the magnetized particles from the photographic element. This reduces an unwanted phenomenon, the so-called developer pick-up (DPU), where some magnetized particles remain stuck to the film.

In a further suitable configuration of the device, the temporally constant field of the amount of the whole magnetic induction of the two magnetic rollers shows a region, which acts repellently on the aligned magnetic dipoles, between the transport cylinder and the photographic element. This represents a magnetic obstacle for the developer. A logjam is caused. The size of the contact surface with the film can be increased in this way, which improves the transfer to the photographic element. In addition, the magnetic forces are reduced in the area of the magnetic minimum, so that the developer can mix more easily.

BRIEF DESCRIPTION OF THE DRAWING

In the detailed description of the preferred embodiment of the invention presented below, reference is made to the accompanying drawing, in which:

Preferred embodiments of the device will be described in more detail below with reference to the illustration. The FIGURE shows the device in a schematic representation.

DETAILED DESCRIPTION OF THE INVENTION

Figure 1:
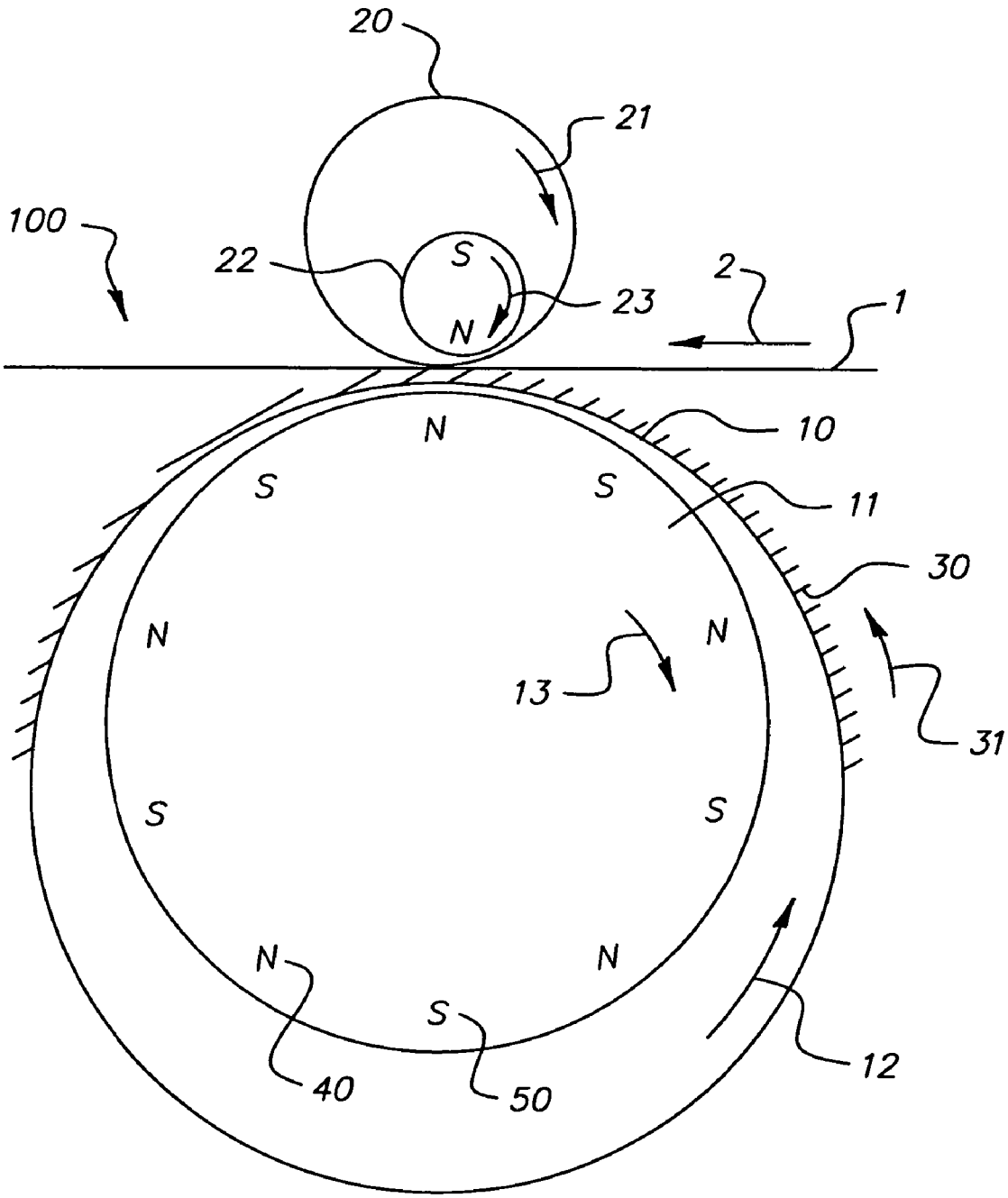

As shown in the FIGURE, a preferable embodiment of the device 100 includes one transport cylinder 10, which can be rotated and is stored ready to be used in contrast to a support cylinder 20. Drive and/or operation means which are generally known about and are necessary for the operation of the device 100, and cam discs and control aids are not shown or only described in a general sense to illustrate the method of action of the device 100.

The transport cylinder 10 and the support cylinder 20 are arranged parallel to each other along the axis and have a narrow transfer gap between them. A flat, endless photographic element 1, basically an image transfer band as is well known in state of the art digital printers and copiers, moves through this transfer gap in the direction of the arrow marked as 2 in the drawing.

Inside the transport cylinder 10, a first magnetic roller 11 is arranged eccentrically but parallel to the axis, which shows a number of north poles 40 and south poles 50; in this example there are five north poles 40 and five south poles 50. The first magnetic roller 11 shows a sine formed magnetic profile. The first magnetic roller 11 turns at speed in the direction of the arrow marked as 13 in the diagram, whereby the rotation speed is more than the speed of the transport cylinder 10. In addition, the rotation direction 13, as shown by the arrow in the FIGURE, of the first magnetic role 11 and the rotation direction 12 of the transport cylinder 10 are opposite to each other. The opposite rotation 13 of the first magnetic roller in terms of the rotation direction 12 of the transport cylinder 10 is not fundamentally necessary; it is enough if both movements result in a relative movement. The rotation direction 12 of the transport cylinder 10 fortunately has the same direction in the transfer zone as the movement direction 2 of the endless photographic element 1.

Inside the support cylinder 20, a second magnetic roller 22 is arranged eccentrically but parallel to the axis, which shows several magnetic north poles and south poles, but in this example is only arranged dual polar, i.e., exactly one north pole and one south pole. The second magnetic roller 22 turns at speed in the direction of the arrow marked as 23 in the diagram. The rotation speed of the second magnetic roller 22 is synchronized with the rotation speed of the first magnetic roller 11 and set in such a way that the first and second magnetic rollers 11, 22 show the same pole alternating frequency. In the example shown, this means that the second magnetic roller 22 turns at five times the speed of the rotation movement of the first magnetic roller. In addition, the rotation direction 23 of the second magnetic roller 22, as shown by the arrow in the FIGURE, and the rotation direction 13 of the first magnetic roller 11 are the same.

In the gap between the transport cylinder 10 and the support cylinder 20, the developer particles 30 come into contact with the photographic element 10; therefore this is termed in this field as the development zone. Here, the magnetic fields of the two magnetic rollers 11, 22 overlap. The second magnetic roller 22 is therefore situated on the reverse side of the photographic element, in order to be as close as possible to the development zone with the limited range of the magnetic fields. How quickly the strength of the magnetic field decreases with the distance depends on the number of the poles 40, 50 of the magnetic rollers in question 11, 22: the more poles 40, 50 there are, the lower the range. Therefore the second magnetic roller 22 is only arranged with two poles.

Developer particles, having at least magnetic carrier particles and non-magnetic marking particles, move on the transport cylinder 10 from a storage area, which is not shown on the diagram but is well known to state of the art specialists, in the direction of the arrow marked with 31 toward the photographic element.

Chains, which are turned by the rotating magnetic field vectors, are caused by a concentrated amount of developer particles 30 that form with each pole alteration because of the overlapping magnetic fields of the first and second magnetic rollers 11, 22. This leads to the developer particles 30 being mixed up. The developer particles 30, which are situated on the surface of the transport cylinder slowly rotating in the direction of the arrow 12, experience an additional relative movement opposite to the rotation direction of the first magnetic roller 11 owing to the rotating magnetic fields.

The marking particles, which were previously attached to the carrier particles triboelectrically, are electrostatically attracted by the photographic element 1 and transported out of the development zone by this through its forward motion. The magnetic carrier particles are, in contrast, transported back to the storage area on the surface of the transport cylinder.

The construction parameters of the individual magnetic rollers 11, 22 (number of poles, radius, maximum field strength) and the distance and turning angle relative to each other, as well as the location relative to the development area are adapted in such a way that a favorable magnetic field results for the developer transport.

The invention has been described in detail with particular reference to certain preferred embodiments thereof, but it will be understood that variations and modifications can be effected within the spirit and scope of the invention.

PARTS LIST

| | |
|---|---|
| 1 | Photographic element |
| 2 | Direction of motion of the photographic element |
| 10 | Transport cylinder |
| 11 | First magnetic roller |
| 12 | Rotation direction of the transport cylinder |
| 13 | Rotation direction of the first magnetic roller |
| 20 | Support cylinder |
| 21 | Rotation direction of the support cylinder |
| 22 | Second magnetic roller |
| 23 | Rotation direction of the second magnetic roller |
| 30 | Developer particles |
| 31 | Direction of motion of the developer particles |
| 40 | Magnetic north pole |
| 50 | Magnetic south pole |
| 100 | Device for the invention |

What is claimed is:

1. Device for the transport of particles (30), in particular developer particles (30), with a first magnetic roller (11) and a second magnetic roller (22), in which the first magnetic roller (11) and the second magnetic roller (22) form a gap, and with a photographic element (1) for the particles (30), which moves through the gap, characterized by the fact that the first and the second magnetic rollers (11, 22) rotate in the same direction.

2. Device according to claim 1, characterized by the fact that the magnetic rollers (11, 22) are multi-polar magnetic rollers (11, 22) with a sine magnetic profile.

3. Device according to claim 2, characterized by the fact that the rotation of the magnetic rollers (11, 22) is synchronized, as the magnetic rollers (11, 22) each turn around their axes in such a way that both have the same pole alternating frequency, whereby the absolute value of the whole magnetic field of the two magnetic rollers (11, 22) is temporally constant.

4. Device according to claim 2, characterized by the fact that the second magnetic roller (22) is dual polar.

5. Device according to claim 2, characterized by the fact that a transport cylinder (10) made of non-magnetic metal is eccentrically arranged around the first magnetic roller (11).

6. Device according to claim 5 characterized by the fact that transport cylinder (10) arranged around the first magnetic roller (22) rotates at a lower speed than the first magnetic roller (11).

7. Device for the transport of particles (30), in particular developer particles (30), with a first magnetic roller (11) and a second magnetic roller (22), in which the first magnetic roller (11) and the second magnetic roller (22) form a gap, and with a photographic element (1) for the particles (30), which moves through the gap, characterized by the fact that a transport cylinder (10) made of non-magnetic metal is eccentrically arranged around the first magnetic roller (11) and rotates at a lower speed than the first magnetic roller (11), and the first and the second magnetic rollers (11, 22) rotate in the same direction such that the temporally constant field of the amount of the whole magnetic induction of the two magnetic rollers (11, 22) shows a region, which acts repellently on the aligned magnetic dipoles, inside the transport cylinder (10) arranged around the first magnetic roller (11) tight under its casing surface.

8. Device for the transport of particles (30), in particular developer particles (30), with a first magnetic roller (11) and a second magnetic roller (22), in which the first magnetic roller (11) and the second magnetic roller (22) form a gap, and with a photographic element (1) for the particles (30), which moves through the gap, characterized by the fact that a transport cylinder (10) made of non-magnetic metal is eccentrically arranged around the first magnetic roller (11) and rotates at a lower speed than the first magnetic roller (11), and the first and the second magnetic rollers (11, 22) rotate in the same direction such that the temporally constant field of the amount of the whole magnetic induction of the two magnetic rollers (11, 22) shows a region, which acts repellently on the aligned magnetic dipoles, on the other side of the photographic element (1).

9. Device for the transport of particles (30), in particular developer particles (30), with a first magnetic roller (11) and a second magnetic roller (22), in which the first magnetic roller (11) and the second magnetic roller (22) form a gap, and with a photographic element (1) for the particles (30), which moves through the gap, characterized by the fact that a transport cylinder (10) made of non-magnetic metal is eccentrically arranged around the first magnetic roller (11) and rotates at a lower speed than the first magnetic roller (11), and the first and the second magnetic rollers (11, 22) rotate in the same direction such that the temporally constant field of the amount of the whole magnetic induction of the two magnetic rollers (11, 22) shows a region, which acts repellently on the aligned magnetic dipoles, between the transport cylinder (10) and photographic element (1).

* * * * *